US009784047B2

(12) United States Patent
Xu et al.

(10) Patent No.: US 9,784,047 B2
(45) Date of Patent: Oct. 10, 2017

(54) EXTENDABLE AND RETRACTABLE STABILIZER

(71) Applicant: Weatherford Technology Holdings, LLC, Houston, TX (US)

(72) Inventors: Wei Jake Xu, Cypress, TX (US); Albert C. Odell, II, Kingwood, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 125 days.

(21) Appl. No.: 14/316,544

(22) Filed: Jun. 26, 2014

(65) Prior Publication Data

US 2015/0000987 A1 Jan. 1, 2015

Related U.S. Application Data

(60) Provisional application No. 61/840,436, filed on Jun. 27, 2013.

(51) Int. Cl.
*E21B 17/10* (2006.01)

(52) U.S. Cl.
CPC ..... *E21B 17/1078* (2013.01); *E21B 17/1014* (2013.01); *E21B 17/1021* (2013.01)

(58) Field of Classification Search
CPC ..... E21B 17/1021; E21B 17/1078
See application file for complete search history.

(56) References Cited

U.S. PATENT DOCUMENTS

| | | | | |
|---|---|---|---|---|
| 5,392,862 | A * | 2/1995 | Swearingen | E21B 10/322 166/239 |
| 5,758,723 | A * | 6/1998 | Saucier | E21B 23/04 166/241.6 |
| 8,794,354 | B2 * | 8/2014 | Xu | E21B 10/322 175/268 |
| 2010/0089583 | A1 | 4/2010 | Xu et al. | |
| 2011/0073376 | A1 | 3/2011 | Radford et al. | |
| 2011/0127044 | A1 | 6/2011 | Radford et al. | |
| 2011/0203849 | A1 * | 8/2011 | Radford | E21B 10/322 175/57 |

OTHER PUBLICATIONS

PCT Search Report and Written Opinion for International Application No. PCT/US2014/044710 dated Apr. 8, 2015.
Australian Patent Examination Report dated Apr. 29, 2016, for Australian Patent Application No. 2014302081.
Canadian Office Action dated Sep. 30, 2016, for Canadian Patent Application No. 2,915,251.

* cited by examiner

*Primary Examiner* — Shane Bomar
(74) *Attorney, Agent, or Firm* — Patterson & Sheridan, LLP

(57) ABSTRACT

A method of drilling a wellbore includes running a drilling assembly into the wellbore through a casing string, the drilling assembly having a tubular string, a stabilizer, and a drill bit; applying a force to an arm of the stabilizer, thereby causing the arm to retract; and removing the stabilizer and the drill bit from the wellbore.

31 Claims, 8 Drawing Sheets

EXTENDABLE AND RETRACTABLE STABILIZER

BACKGROUND OF THE INVENTION

Field of the Invention

Embodiments of the present invention generally relate to a stabilizer.

Description of the Related Art

Stabilizers have been used to support a drill string during a drilling operation. The stabilizers have a larger outside diameter than the drill collars and are in constant rotational contact with the sidewall of the wellbore during the drilling process. The problem with stabilizers is that the contact between the stabilizer and the wellbore can be the source of many problems. For example, penetrated, soft formations may collapse or swell inwardly after penetration of the bit which may in turn cause the stabilizer to become stuck. In addition, the stabilizer may become stuck during retrieval, such as hanging up on a ledge or a "dune" of cuttings.

Freeing a stuck pipe generally requires tremendous effort and time. Often the drill string and expensive bottom hole drilling/measurement tools must be left downhole and the wellbore re-drilled.

There is a need therefore, for a stabilizer that is capable of being selectively collapsed to reduce its outside diameter if the stabilizer becomes stuck.

SUMMARY OF THE INVENTION

In one embodiment, a method of drilling a wellbore includes running a drilling assembly into the wellbore through a casing string, the drilling assembly comprising a tubular string, a stabilizer, and a drill bit; applying a force to an arm of the stabilizer, thereby causing the arm to retract; and removing the stabilizer and the drill bit from the wellbore.

In another embodiment, a stabilizer for use in a wellbore includes a tubular body; a mandrel disposed in the tubular body; an arm rotatably coupled to the mandrel and movable between an extended position and a retracted position; and a coupling sleeve for retaining the arm in the extended position, wherein the coupling sleeve is releasably coupled to the tubular body.

In another embodiment, an assembly for forming a wellbore includes a tubular string; a drill bit coupled to the tubular string; an underreamer coupled to the tubular string; and a stabilizer coupled to the tubular string. The stabilizer may include a tubular body; a mandrel disposed in the tubular body; an arm rotatably coupled to the mandrel and movable between an extended position and a retracted position; and a coupling sleeve for retaining the arm in the extended position, wherein the coupling sleeve is releasably coupled to the tubular body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
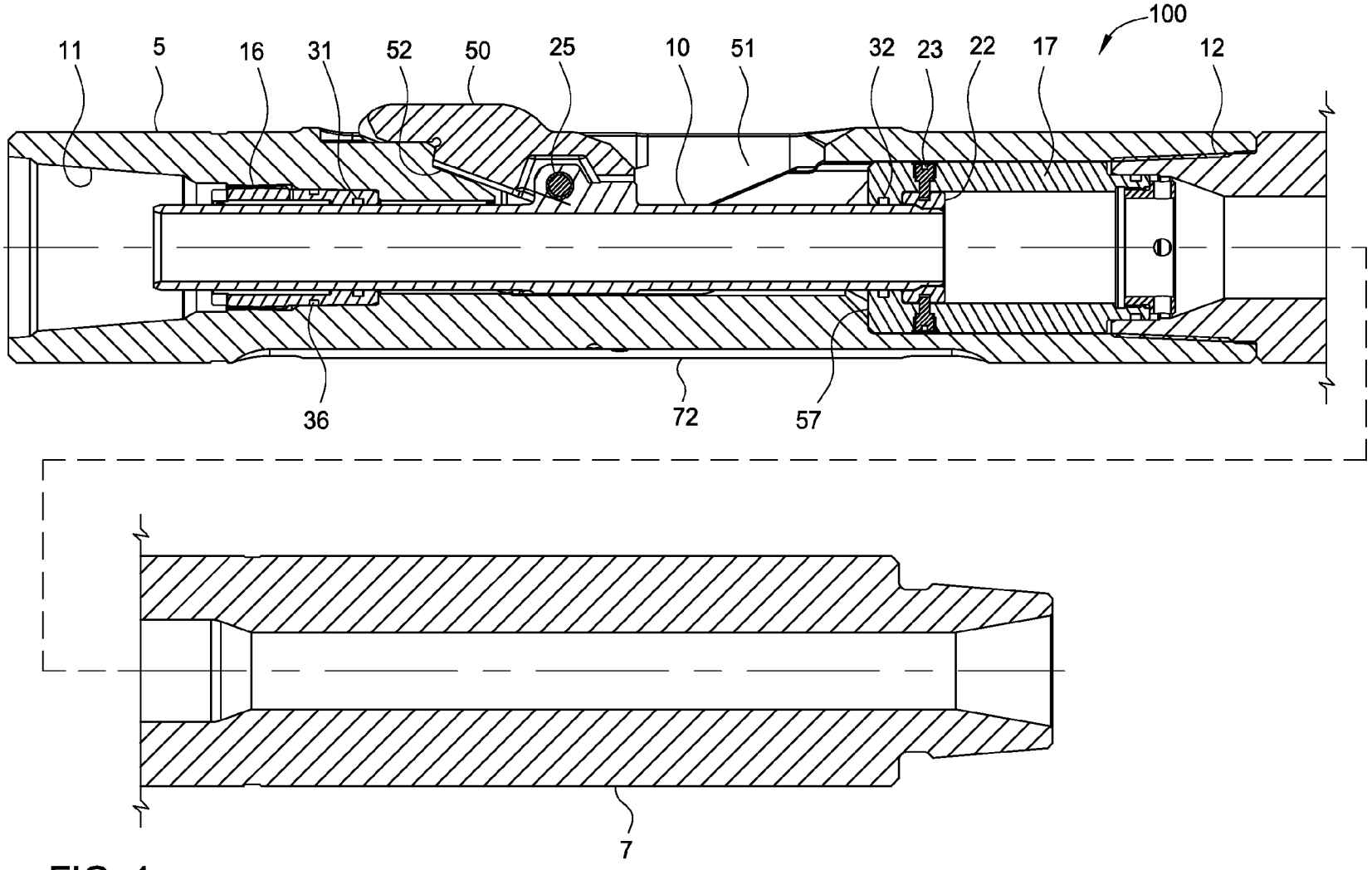
FIGS. 1 and 2 are cross-sectional views of an embodiment of a stabilizer in an extended position and a retracted position, respectively.
Figure 2:
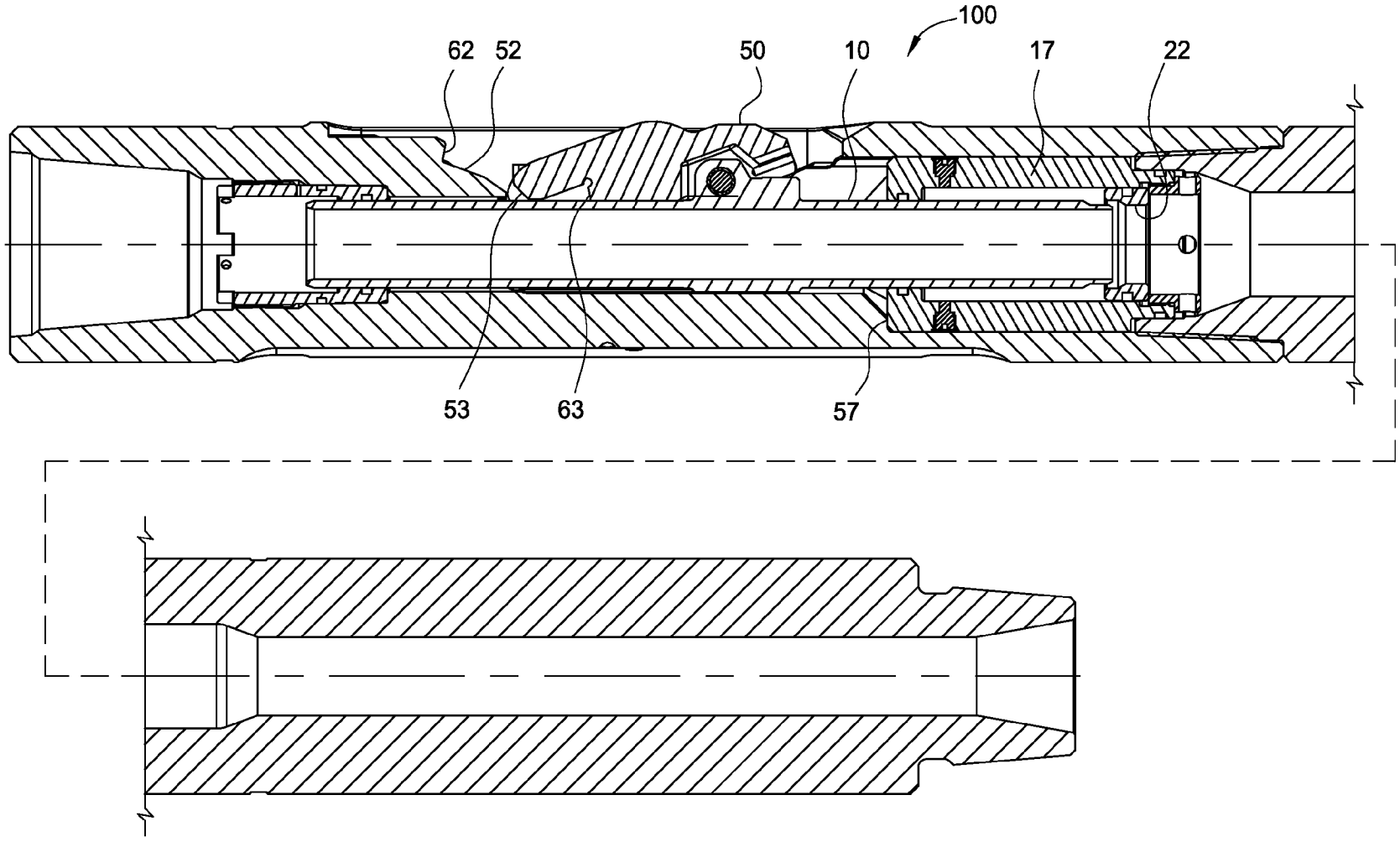

FIGS. 1 and 2 are cross-sectional views of a stabilizer 100 in an extended position and a retracted position, respectively, according to one embodiment of the present invention.

The stabilizer 100 may include a body 5, an adapter 7, a mandrel 10, one or more seal sleeves 16, 17, and one or more arms 50. The body 5 may be tubular and have a longitudinal bore formed therethrough. Each longitudinal end 11, 12 of the body 5 may be threaded for longitudinal and rotational coupling to other members, such as a drill string at one end 11 and the adapter 7 at the other end 12. The body 5 may have an opening 51 formed through a wall thereof for accommodating an arm 50. The body 5 may also have a recess formed therein at least partially defined by shoulder 57 for receiving the lower seal sleeve 17. The body 5 may include a profile 52 formed in a surface thereof for engaging each arm 50 adjacent the opening 51. The upper seal sleeve 16 may be longitudinally coupled to the body 5 by a threaded connection. The lower seal sleeve 17 may be longitudinally coupled to the body 5 by being disposed between the shoulder 57 and a top of the adapter 7. An end of the adapter 7 distal from the body 5 may be threaded for longitudinal and rotational coupling to another member of a bottom hole assembly (BHA). The BHA may include one or more tools such as a drill bit, a first underreamer, a second underreamer, a measuring while drilling tool, a logging while drilling tool, and combinations thereof. The BHA and the stabilizer may be coupled to a tubular string, such as a drill pipe string or a casing string.

The mandrel 10 may be a tubular having a longitudinal bore formed therethrough, and may be disposed in the bore of the tubular body 5. The mandrel 10 is coupled to the lower seal sleeve 17 using a coupling sleeve 22. The lower end of the mandrel 10 is abutted against the coupling sleeve 22, which in turn, is releasably connected to the lower seal sleeve 17 using a shearable member 23 such as a shear screw, a pin, or a collet. This arrangement prevents the arms 50 from retracting prematurely. In this embodiment, the coupling sleeve 22 is abutted to a smaller diameter portion at the lower end of the mandrel 10. In another embodiment, the mandrel 10 is connected to the lower seal sleeve 17 using a shearable member. In yet another embodiment, the arm 50 may be retained in the extended position using a shearable member that attaches the arm 50 to the body 5. In one example, each of the arms 50 may have a shear pin to retain the arm 50 against the body 5. A lower seal 32 is disposed between an outer surface of the mandrel 10 and an inner surface of the lower seal sleeve 17. An upper seal 31 may be disposed between the upper seal sleeve 16 and an outer surface of the mandrel 10. The upper seal 31 and lower seals 32 may be a ring or stack of seals, such as chevron seals, and made from a polymer, such as an elastomer. Various other seals, such as o-rings may be disposed throughout the stabilizer 100. For example, an outer seal 36 may be disposed between the upper seal sleeve 16 and the tubular body 5. As shown, the mandrel 10 is pressure balanced as a result of the upper seal 31 and the lower seal 32 having the same size. As such, the mandrel 10 will not be moved by the fluid flowing through the stabilizer 100. In another embodiment, the lower seal 32 may be larger than the upper seal 31 such that the mandrel 10 is no longer pressure balanced. In this respect, the mandrel 10 may bias the arm 50 in the extended position when fluid flows through the stabilizer.

Each arm 50 may be movable between an extended position and a retracted position and may initially be disposed in the opening 51 in the extended position, as shown in FIG. 1. Each arm 50 may be pivotable relative to the mandrel 10 via a fastener 25. A surface of the body 5 defining each opening 51 may serve as a rotational stop for a respective arm 50, thereby rotationally coupling the arm 50 to the body 5 (in both the extended and retracted positions). Each arm 50 may include a profile 53 (shown in FIG. 2) formed in an inner surface thereof for engaging the corresponding profile 52. Movement of each arm 50 along the profile 52 forces the arm 50 radially outward from the retracted position to the extended position. Each profile 52, 53 may include a shoulder 62, 63. The shoulders 62, 63 may be inclined relative to a radial axis of the body 5 in order to secure each arm 50 to the body 5 in the extended position so that the arms 50 do not chatter or vibrate during use. The inclination of the shoulders 62, 63 may create a radial component of the normal reaction force between each arm 50 and the body 5, thereby holding each arm 50 radially inward in the extended position. Additionally, the shoulders 62, 63 may each be circumferentially inclined (not shown) to retain the arms 50 against a trailing surface of the body 5 defining the opening 51 to further ensure against chatter or vibration.

The arms 50 may be longitudinally aligned and circumferentially spaced around the body 5. Optionally, junk slots 72 may be formed in an outer surface of the body 5 between the arms 50. The junk slots 72 may extend the length of the openings 51 to maximize cooling and cuttings removal from the drill bit. The arms 50 may be concentrically arranged about the body 5 to reduce vibration during drilling. The stabilizer 100 may include a plurality of arms 50, and each arm 50 may be spaced circumferentially. In one embodiment, the stabilizer 100 is equipped with three arms 50, although the stabilizer 100 may have two, four, five, or more arms. The arms 50 may be made from a high strength metal or alloy, such as steel. The outer surface of the arms 51 may be arcuate, such as parabolic, semi-elliptical, semi-oval, or semi-super-elliptical. The arcuate arm shape may include a straight or substantially straight gage portion and curved leading and trailing ends.

In use, the stabilizer 100 may be run into the wellbore in the configuration shown in FIG. 1. In this configuration, the arm 50 is prevented from retracting due to the shearable member 23.

In the event the stabilizer 100 becomes stuck, such as during retrieval, an upward force sufficient to shear the shearable member 23 is applied to the stabilizer 100. In one example, the upward force urges the arm 50 against a restriction in the wellbore, which transfers the force to the shearable member 23 via the mandrel 10 and the coupling sleeve 22. The transferred force shears the shearable member 23, which frees the coupling sleeve 22 to move downwardly and away from the mandrel 10. No longer abutted by the coupling sleeve 22, the mandrel 10 is allowed to move relative to the body 5. A downward force from the restriction acting on the arm 50 may be translated to the mandrel 10, thereby causing the mandrel to move downwardly in the body 5. In turn, the arm 50 is moved along with the mandrel 10, thereby rotating the arms inwardly to retract the arms, as shown in FIG. 2. In this manner, the outer diameter of the stabilizer 100 is reduced to allow for movement through the restriction in the wellbore. As seen in FIG. 2, the coupling sleeve 22 may land on a shoulder formed at a lower portion of the seal sleeve 17.

If fluid flow is restarted, the arms 50 will not re-extend because the mandrel 10 is pressure balanced. In another embodiment, the mandrel 10 is not pressure balanced and is biased upwards when the mud pumps are flowing. In yet another embodiment, the stabilizer may include a locking device to retain the mandrel 10 in the retracted position. For example, the locking device may be a collet such as a square shouldered collet. The fingers of the collet may expand into a recess after the arms 50 have retracted thereby locking the arms 50 and the mandrel 10 in the retracted position. The locking device may prevent the arm 50 from extending when fluid is flowing through the mandrel 10.

Figure 3:
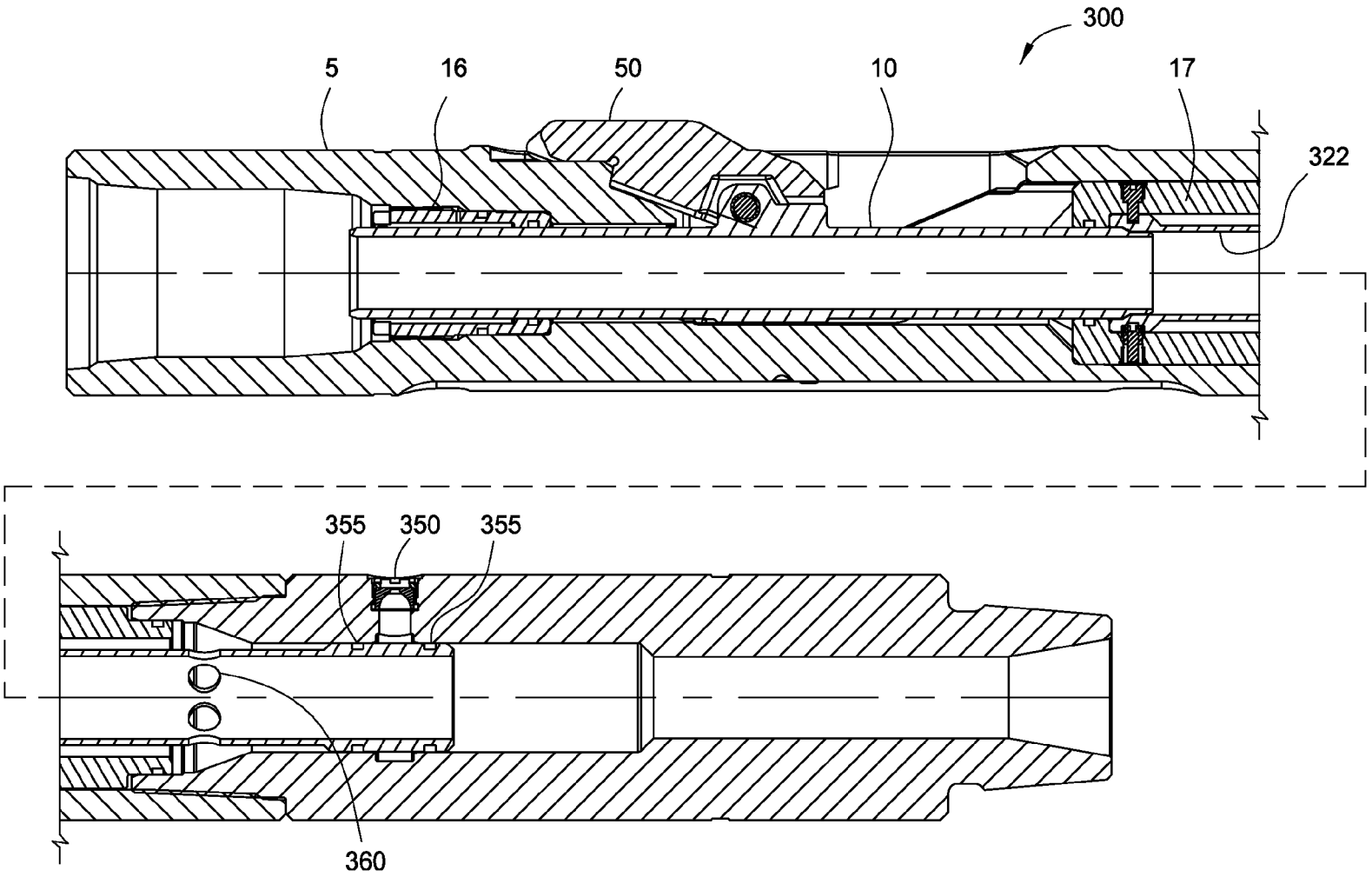
FIGS. 3 and 4 are cross-sectional views of another embodiment of a stabilizer in an extended position and a retracted position, respectively.
Figure 4:
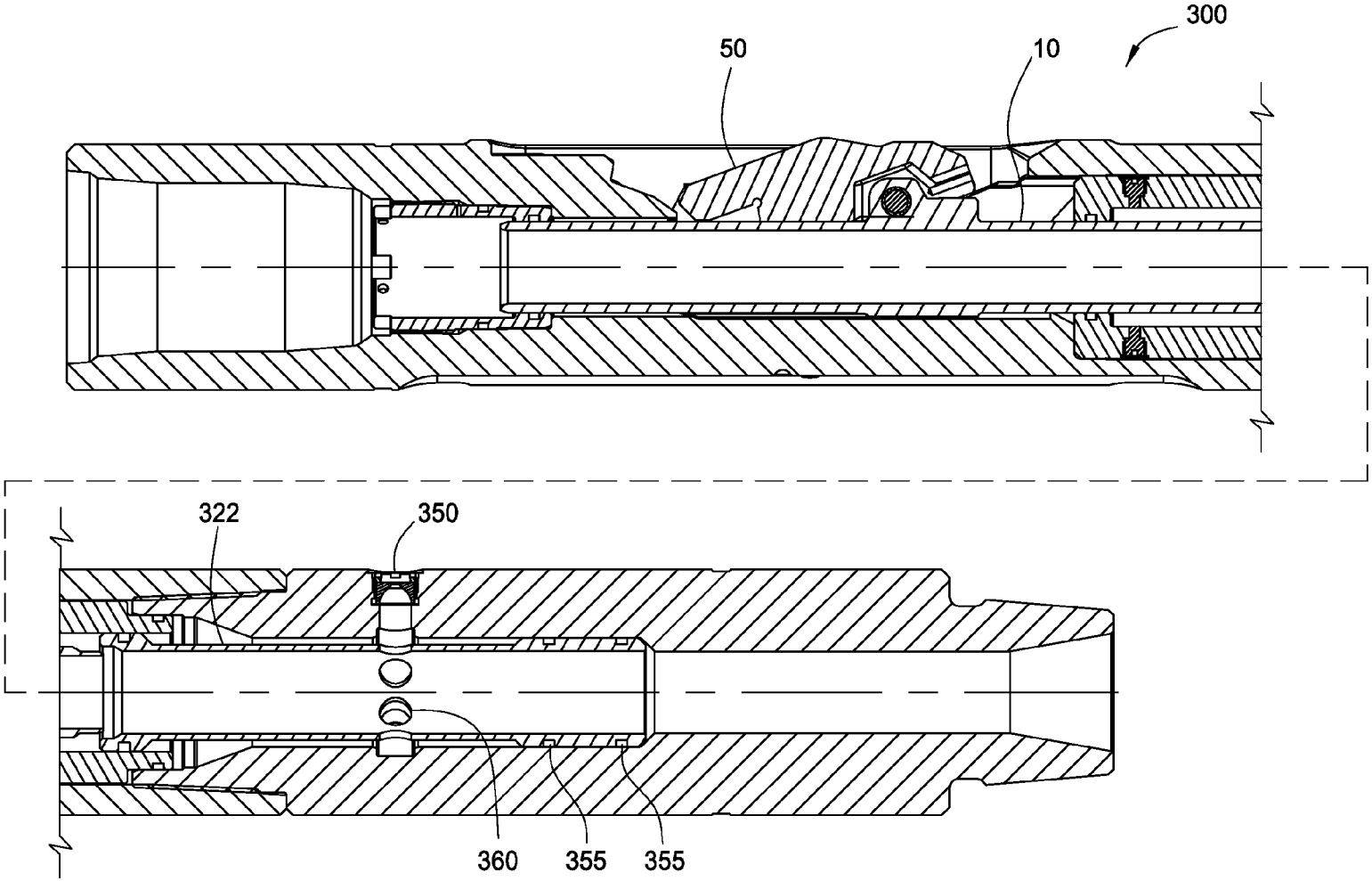

FIGS. 3 and 4 illustrate another embodiment of a stabilizer 300. This stabilizer 300 has many of the same features described with respect to the stabilizer 100 shown in FIG. 1. For sake of clarity, the same reference numbers will be used to denote the same features.

In this embodiment, the stabilizer 300 includes one or more fluid ports 350 for selective fluid communication through the body 5. The fluid port 350 may be blocked by the coupling sleeve 322 when the arm 50 is in the extended position, as shown in FIG. 3. The upper end of the coupling sleeve 322 abuts the mandrel 10 and is connected to the lower seal sleeve 17 using the shearable member 23. The lower end of the coupling sleeve 322 includes two seals 355 disposed between the coupling sleeve 322 and the body 5 and straddling the fluid port 350 for blocking fluid communication through the fluid ports 350. The coupling sleeve 322 also includes openings 360 adapted to align with the fluid ports 350 when the arms 50 are in the retracted position.

In use, the stabilizer 300 may be run into the wellbore in the configuration shown in FIG. 3. In the event the stabilizer 300 becomes stuck, such as during retrieval, an upward force sufficient to shear the shearable member 23 may be applied to the stabilizer 300. After shearing the shearable member 23, the mandrel 10 is free to move in response to a force applied to the arm 50. A downward force from the restriction acting on the arm 50 causes the mandrel 10 and the coupling sleeve 322 to move downwardly. In turn, the arm 50 is moved along with the mandrel 10, thereby allowing the arms to rotate inwardly to retract the arms, as shown in FIG. 4. Also, the coupling sleeve 322 is moved to a position where the openings 360 are aligned with the fluid port 350. In this manner, the outer diameter of the stabilizer 300 is reduced to allow for movement through a restriction in the wellbore.

If fluid flow is restarted, the arms 50 will not re-extend because the mandrel 10 is pressure balanced. However, the fluid is allowed to flow out of the fluid ports 360. The fluid outflow may assist with fluid circulation and/or clearing the annular area between the stabilizer and the wellbore.

Figure 5:
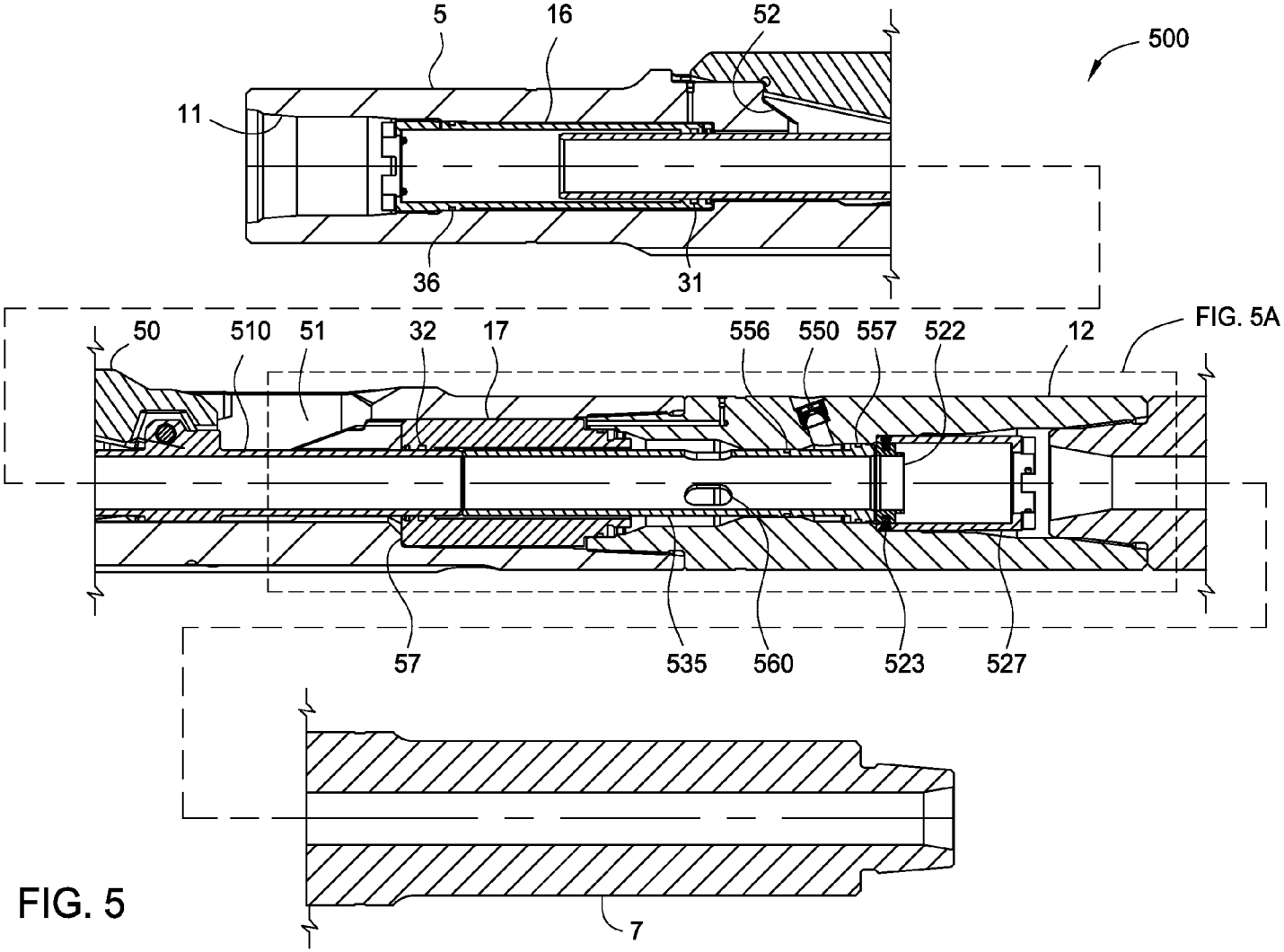
FIG. 5 is a cross-sectional view of another embodiment a stabilizer in an extended position.
Figure 5A:
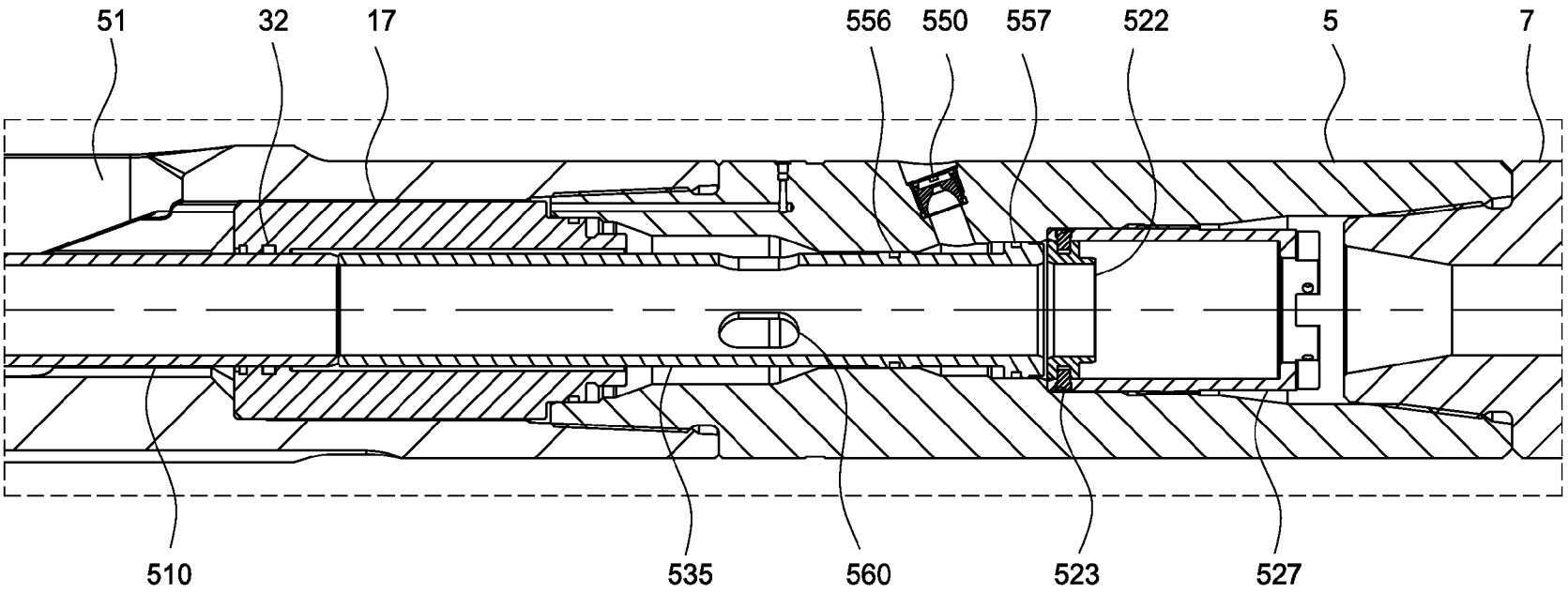
FIG. 5A is an enlarged, partial cross-sectional view of the stabilizer of FIG. 5.
Figure 6:
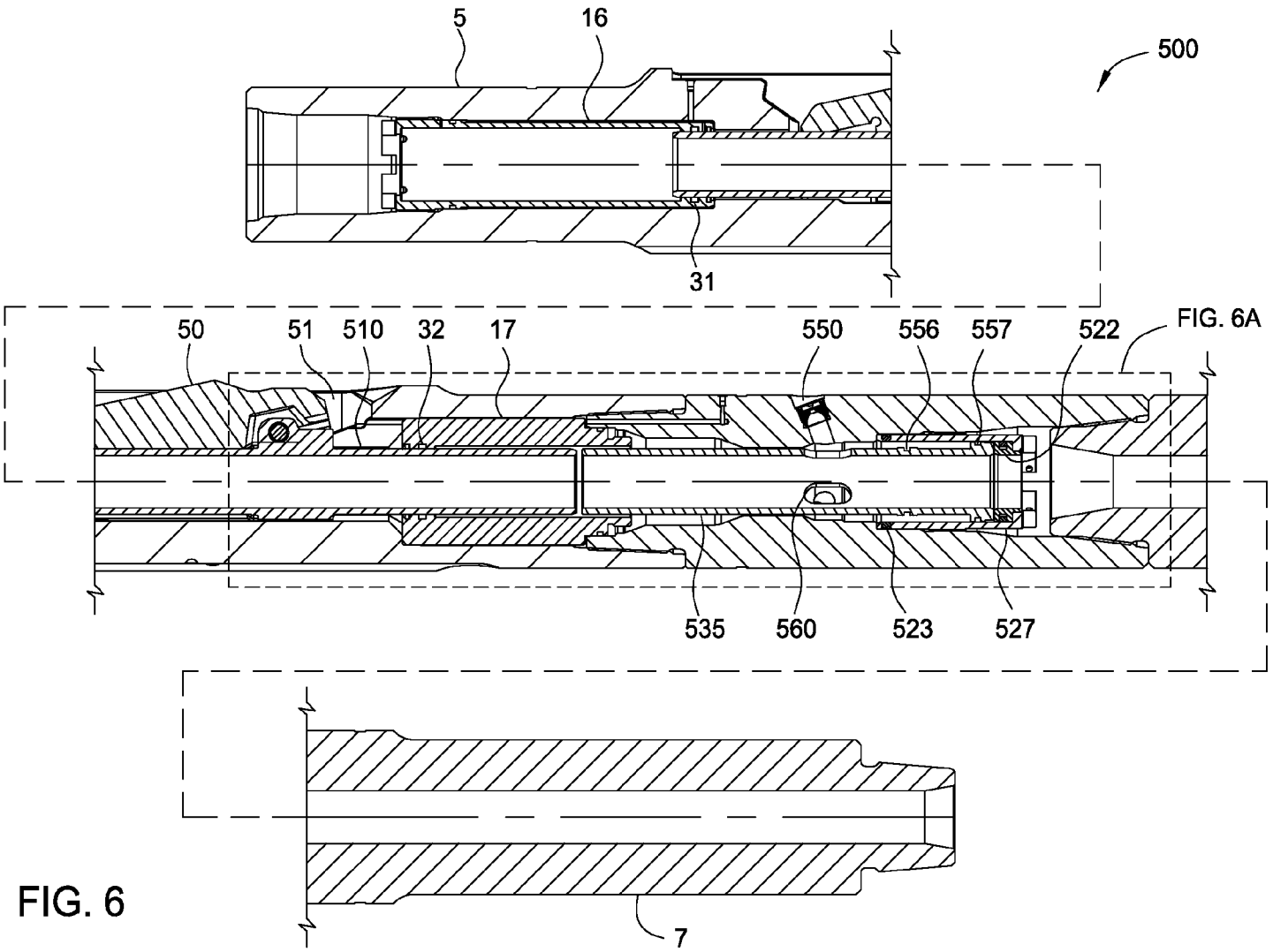
FIG. 6 is a cross-sectional view of another embodiment a stabilizer in a retracted position.
Figure 6A:
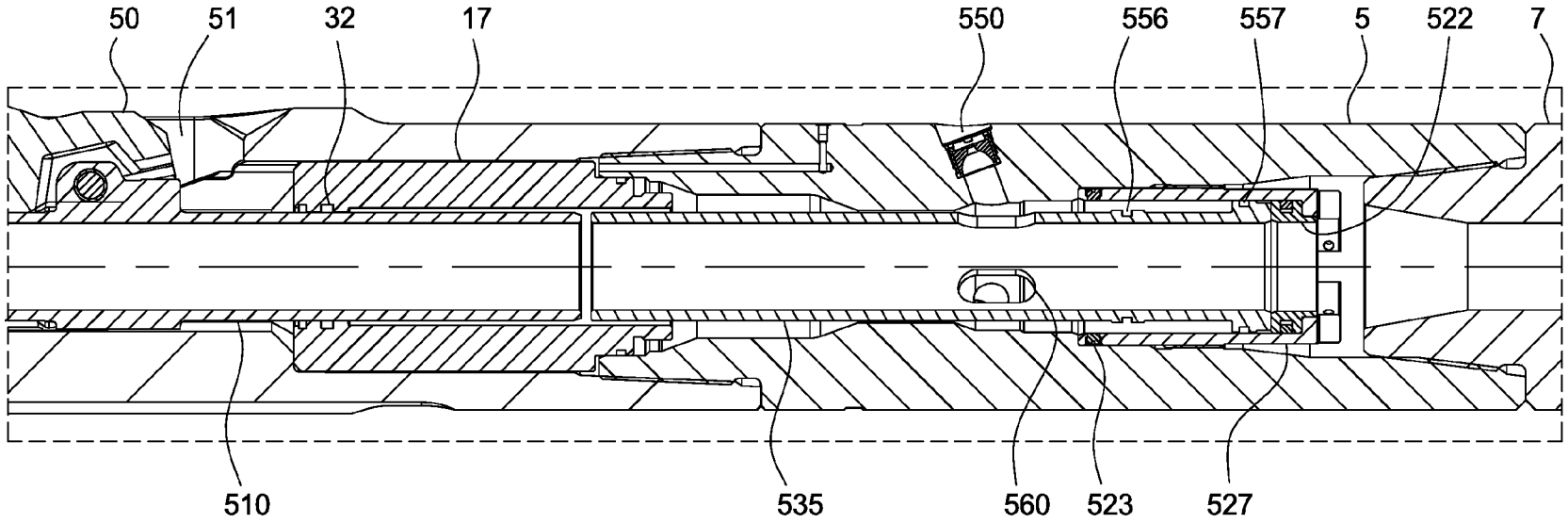
FIG. 6A is an enlarged, partial cross-sectional view of the stabilizer of FIG. 6.

FIGS. 5 and 6 illustrate another embodiment of a stabilizer 500. This stabilizer 500 has many of the same features described with respect to stabilizers 100, 300 shown in FIGS. 1 and 3. For sake of clarity, the same reference numbers will be used to denote the same features. FIGS. 5 and 6 are cross-sectional views of the stabilizer 500 in an extended position and a retracted position, respectively. FIGS. 5A and 6A are enlarged, partial cross-sectional views of the stabilizer 500 of FIGS. 5 and 6, respectively.

In this embodiment, the stabilizer 500 may include a body 5, an adapter 7, a mandrel 510, one or more seal sleeves 16, 17, and one or more arms 50. The body 5 may be tubular and have a longitudinal bore formed therethrough. Each longitudinal end 11, 12 of the body 5 may be threaded for longitudinal and rotational coupling to other members, such as a drill string at one end 11 and the adapter 7 at the other end 12. The body 5 may have an opening 51 formed through a wall thereof for accommodating an arm 50. The body 5 may also have a recess formed therein at least partially defined by shoulder 57 for receiving the lower seal sleeve 17. The body 5 may include a profile 52 formed in a surface thereof for engaging each arm 50 adjacent the opening 51. The upper seal sleeve 16 may be longitudinally coupled to the body 5 by a threaded connection. The lower seal sleeve 17 may be longitudinally coupled to the body 5 by being disposed between the shoulder 57 and a top of the adapter 7. An end of the adapter 7 distal from the body 5 may be threaded for longitudinal and rotational coupling to another member of a bottom hole assembly (BHA).

The mandrel 510 may be a tubular having a longitudinal bore formed therethrough, and may be disposed in the bore of the tubular body 5. The upper end of the mandrel 510 is at least partially disposed in the upper seal sleeve 16 and the lower end of the mandrel 510 is at least partially disposed in the lower seal sleeve 17. A lower seal 32 is disposed between an outer surface of the mandrel 510 and an inner surface of the lower seal sleeve 17. An upper seal 31 is disposed between the upper seal sleeve 16 and an outer surface of the mandrel 510. The upper seal 31 and lower seals 32 may be a ring or stack of seals, such as chevron seals, and made from a polymer, such as an elastomer. Various other seals, such as o-rings may be disposed throughout the stabilizer 500. For example, an outer seal 36 may be disposed between the upper seal sleeve 16 and the tubular body 5. As shown, the mandrel 510 is pressure balanced as a result of the upper seal 31 and the lower seal 32 having the same size. As such, the mandrel 510 will not move in response to fluid flowing through the stabilizer 500.

A piston sleeve 535 is disposed between the mandrel 510 and a coupling sleeve 522. The coupling sleeve 522, in turn, is releasably connected to a retainer sleeve 527 using a shearable member 523 such as a shear screw, a pin, or a collet. The retainer sleeve 527 may be threadedly connected to the body 5. This arrangement prevents the arms 50 from retracting prematurely. In one embodiment, the piston sleeve 535 is movable relative to the coupling sleeve 522, the mandrel 510, or both. The piston sleeve 535 includes two seals 556, 557 disposed between the piston sleeve 535 and the body 5 and straddling the fluid port 550. The seals 556, 557 block fluid communication through the fluid ports 550 when the stabilizer 500 is in the extended position. The upper seal 556 has a smaller diameter than the lower seal 557. In this respect, the piston sleeve 535 is not pressure balanced. When fluid is flowing through the stabilizer 500, the piston sleeve 535 is urged upward to help retain the mandrel 510 and the arms 50 in the extended position. In this embodiment, the piston sleeve 535 is not attached to the coupling sleeve 522 and can move upward relative to the coupling sleeve 522. This arrangement prevents the piston sleeve 535 from applying an upward force on the coupling sleeve 522 and the shearable member 523 when fluid is flowing through the stabilizer 500.

In one embodiment, the stabilizer 500 includes one or more fluid ports 550 for selective fluid communication through the body 5. The fluid ports 550 are blocked by the piston sleeve 535 when the arms 50 are in the extended position, as shown in FIGS. 5 and 5A. The piston sleeve 535 also includes openings 560 adapted to align with the fluid ports 550 when the arms 50 are in the retracted position.

In use, the stabilizer 500 may be run into the wellbore in the extended configuration shown in FIG. 5. In this configuration, the arm 50 is prevented from retracting due to the shearable member 523 and the piston sleeve 535. When fluid is flowing through the stabilizer 500, the piston sleeve 535 is allowed to move upward relative to the coupling sleeve 522 to help maintain the arms 50 in the extended position.

In the event the stabilizer 500 becomes stuck, such as during retrieval, an upward force sufficient to shear the shearable member 523 is applied to the stabilizer 500. For example, the tool string may be pulled upward to apply the upward force to the stabilizer. The upward force urges the arms 50 against a restriction in the wellbore, which transfers the force to the shearable member 523 via the mandrel 510, the piston sleeve 535, and the coupling sleeve 522. The transferred force shears the shearable member 523, which frees the coupling sleeve 522 to move downward and away from the mandrel 510. No longer abutted by the coupling sleeve 522, the mandrel 510 and the piston sleeve 535 are allowed to move relative to the body 5. A downward force from the restriction acting on the arms 50 may be translated to the mandrel 510 and the piston sleeve 535, thereby causing the mandrel 510 and the piston sleeve 535 to move downward in the body 5. Because the arms 50 are moved along with the mandrel 510, the arms 50 are rotated inwardly to retract the arms 50, as shown in FIGS. 6 and 6A. In this manner, the outer diameter of the stabilizer 500 is reduced to allow for movement through the restriction in the wellbore. As seen in FIG. 6A, the coupling sleeve 522 has landed on a shoulder formed at a lower portion of the retainer sleeve 527.

If fluid flow is restarted, the arms 50 will not re-extend because the mandrel 510 is pressure balanced and the upper seal 556 of the piston sleeve 535 is no longer engaged. As shown in FIG. 6A, the upper seal 556 has moved into the retainer sleeve 527, which has an inner diameter that is larger than the diameter of the upper seal 556. As a result, the upper seal 556 cannot sealingly engage the retainer 527. Consequently, the fluid flow can no longer move the piston sleeve 535 upward to urge the mandrel 510 and the arms 50 to the extended position. Also, in the retracted position, the openings 560 of the piston sleeve 535 are in position for fluid communication with the ports 550. The fluid is allowed to flow out of the openings 560 and through the fluid ports 550. The fluid outflow may assist with fluid circulation and/or clearing the annular area between the stabilizer 500 and the wellbore. In yet another embodiment, the stabilizer may include a locking device to retain the mandrel 510 in the retracted position.

In one embodiment, a method of drilling a wellbore includes running a drilling assembly into the wellbore through a casing string, the drilling assembly comprising a tubular string, a stabilizer, and a drill bit; applying a force to an arm of the stabilizer, thereby causing the arm to retract; and removing the stabilizer and the drill bit from the wellbore.

In one or more of the embodiments described herein, the arm of the stabilizer is run-in in an extended position.

In one or more of the embodiments described herein, a shearable member is used to retain the arm in the extended position.

In one or more of the embodiments described herein, the force applied to the arm is sufficient to shear the shearable member.

In one or more of the embodiments described herein, the force is applied by urging the arm against a restriction in the wellbore.

In one or more of the embodiments described herein, the method also includes opening a fluid port when the arm is retracted.

In another embodiment, a stabilizer for use in a wellbore includes a tubular body; a mandrel disposed in the tubular body; an arm rotatably coupled to the mandrel and movable between an extended position and a retracted position; and a coupling sleeve for retaining the arm in the extended position, wherein the coupling sleeve is releasably coupled to the tubular body.

In another embodiment, an assembly for forming a wellbore includes a tubular string; a drill bit coupled to the tubular string; an underreamer coupled to the tubular string; and a stabilizer coupled to the tubular string. The stabilizer may include a tubular body; a mandrel disposed in the tubular body; an arm rotatably coupled to the mandrel and movable between an extended position and a retracted position; and a coupling sleeve for retaining the arm in the extended position, wherein the coupling sleeve is releasably coupled to the tubular body.

In one or more of the embodiments described herein, a shearable member releasably couples the coupling sleeve to the tubular body.

In one or more of the embodiments described herein, a seal sleeve is attached to the body, and the coupling sleeve is releasably coupled to the tubular body via the seal sleeve.

In one or more of the embodiments described herein, the mandrel is pressure balanced.

In one or more of the embodiments described herein, the arm is movable to the retracted position when the coupling sleeve is released from the tubular body.

In one or more of the embodiments described herein, a fluid port is formed in the tubular body.

In one or more of the embodiments described herein, the coupling sleeve blocks fluid communication through the fluid port when the arm is in the extended position.

In one or more of the embodiments described herein, a plurality of seals are disposed on the coupling sleeve for blocking fluid communication.

In one or more of the embodiments described herein, a piston sleeve is disposed between the mandrel and the coupling sleeve.

In one or more of the embodiments described herein, the piston sleeve is movable relative to the coupling sleeve.

In one or more of the embodiments described herein, a first seal is disposed on the piston sleeve and a second seal is disposed on the piston sleeve, wherein the second seal has a larger outer diameter than the first seal.

In one or more of the embodiments described herein, the piston sleeve, the first seal, and the second seal are configured to block fluid communication through the fluid port when the arm is in the extended position.

In one or more of the embodiments described herein, when the arm is in the extended position, the first seal is sealingly engaged with the body, and wherein when the arm is in the retracted position, the first seal is not sealingly engaged with any surface.

While the foregoing is directed to embodiments of the present invention, other and further embodiments of the invention may be devised without departing from the basic scope thereof, and the scope thereof is determined by the claims that follow.

The invention claimed is:

1. A stabilizer for use in a wellbore, comprising:

a tubular body;

a mandrel disposed in the tubular body;

an arm rotatably coupled to the mandrel and movable between an extended position and a retracted position; and a coupling sleeve retaining the arm in the extended position, the coupling sleeve being releasably coupled to the tubular body and axially fixed relative to the mandrel prior to release.

2. The stabilizer of claim 1, further comprising a shearable member for releasably coupling the coupling sleeve to the tubular body.

3. The stabilizer of claim 2, further comprising a seal sleeve attached to the body.

4. The stabilizer of claim 3, wherein the coupling sleeve is disposed between the seal sleeve and the mandrel.

5. The stabilizer of claim 1, wherein the mandrel is pressure balanced.

6. The stabilizer of claim 1, wherein the arm is movable to the retracted position when the coupling sleeve is released from the tubular body.

7. The stabilizer of claim 1, further comprising a fluid port formed in the tubular body.

8. The stabilizer of claim 7, wherein the coupling sleeve blocks fluid communication through the fluid port when the arm is in the extended position.

9. The stabilizer of claim 8, further comprising a plurality of seals disposed on the coupling sleeve for blocking fluid communication.

10. The stabilizer of claim 1, further comprising a piston sleeve disposed between the mandrel and the coupling sleeve.

11. The stabilizer of claim 10, wherein the piston sleeve is movable relative to the coupling sleeve.

12. The stabilizer of claim 10, further comprising a first seal disposed on the piston sleeve and a second seal disposed on the piston sleeve, wherein the second seal has a larger outer diameter than the first seal.

13. The stabilizer of claim 12, further comprising a fluid port formed in the tubular body.

14. The stabilizer of claim 13, wherein the piston sleeve, the first seal, and the second seal are configured to block fluid communication through the fluid port when the arm is in the extended position.

15. The stabilizer of claim 12, wherein when the arm is in the extended position, the first seal is sealingly engaged with the tubular body, and wherein when the arm is in the retracted position, the first seal is not sealingly engaged with the tubular body.

16. The stabilizer of claim 10, wherein the coupling sleeve is releasably coupled to the tubular body via a retainer sleeve.

17. The stabilizer of claim 10, wherein:

when the coupling sleeve is releasably coupled to the tubular body, the piston sleeve is configured to move the mandrel and the arm to the extended position; and when the coupling sleeve is released from the tubular body, the piston sleeve is configured to allow the mandrel and the arm to move to the retracted position.

18. The stabilizer of claim 1, wherein the coupling sleeve is released in response to a force applied to the arm.

19. An assembly for forming a wellbore, comprising:

a tubular string;

a drill bit coupled to the tubular string;

an underreamer coupled to the tubular string; and a stabilizer coupled to the tubular string, having:

a tubular body;

a mandrel disposed in the tubular body;

an arm rotatably coupled to the mandrel and movable between an extended position and a retracted position; and a coupling sleeve retaining the arm in the extended position, the coupling sleeve being releasably coupled to the tubular body and axially fixed relative to the mandrel prior to release.

20. The assembly of claim 19, further comprising a piston sleeve disposed between the mandrel and the coupling sleeve.

21. The assembly of claim 20, wherein the piston sleeve is movable relative to the coupling sleeve.

22. The assembly of claim 20, further comprising a first seal disposed on the piston sleeve and a second seal disposed on the piston sleeve, wherein the second seal has a larger outer diameter than the first seal.

23. The assembly of claim 22, wherein when the arm is in the extended position, the first seal is sealingly engaged with the tubular body, and wherein when the arm is in the retracted position, the first seal is not sealingly engaged with the tubular body.

24. A stabilizer for use in a wellbore, comprising:

a tubular body;

a mandrel disposed in the tubular body;

an arm rotatably coupled to the mandrel and movable between an extended position and a retracted position; and a coupling sleeve retaining the arm in the extended position, the coupling sleeve being releasably coupled to the tubular body and wherein the mandrel is pressure balanced such that the mandrel is not movable in response to a change in fluid pressure when the arm is in the retracted position.

25. A stabilizer for use in a wellbore, comprising:

a tubular body;

a mandrel disposed in the tubular body;

an arm rotatably coupled to the mandrel and movable between an extended position and a retracted position; and a coupling sleeve retaining the arm in the extended position, the coupling sleeve being releasably coupled to the tubular body, wherein the coupling sleeve is released in response to a force applied to the arm.

26. The stabilizer of claim 25, further comprising a shearable member for releasably coupling the coupling sleeve to the tubular body.

27. The stabilizer of claim 26, further comprising a seal sleeve attached to the body.

28. The stabilizer of claim 25, further comprising a piston sleeve disposed between the mandrel and the coupling sleeve.

29. The stabilizer of claim 28, wherein the piston sleeve is movable relative to the coupling sleeve.

30. The stabilizer of claim 28, wherein:

when the coupling sleeve is releasably coupled to the tubular body, the piston sleeve is configured to move the mandrel and the arm to the extended position; and when the coupling sleeve is released from the tubular body, the piston sleeve is configured to allow the mandrel and the arm to move to the retracted position.

31. The stabilizer of claim 25, wherein the coupling sleeve is releasably coupled to the tubular body via a retainer sleeve.

* * * * *